US006626553B2

(12) United States Patent
Zhao et al.

(10) Patent No.: US 6,626,553 B2
(45) Date of Patent: Sep. 30, 2003

(54) SHELL BODY LIGHT SCULPTURE

(76) Inventors: Haicheng Zhao, No. 15 Nan Tuanjie Street, Hanzhong, Shaanxi Province 723000 (CN); Wenxin Li, No. 15, Nan Tuanjie Street, Hanzhong, Shaanxi Province 723000 (CN)

( * ) Notice: Subject to any disclaimer, the term of this patent is extended or adjusted under 35 U.S.C. 154(b) by 0 days.

(21) Appl. No.: 09/789,225

(22) Filed: Feb. 20, 2001

(65) Prior Publication Data

US 2002/0003701 A1 Jan. 10, 2002

(30) Foreign Application Priority Data

Jul. 7, 2000 (CN) ..... 00 2 26583 U

(51) Int. Cl.[7] ..... F21V 21/00

(52) U.S. Cl. ..... 362/124; 362/249; 362/806; 362/252

(58) Field of Search ..... 362/124, 806, 362/249, 252, 808, 226

(56) References Cited

U.S. PATENT DOCUMENTS 4,953,066 A * 8/1990 Schiffer ..... 362/252
5,755,508 A * 5/1998 Wheaton ..... 362/249
6,033,088 A * 3/2000 Contigiani ..... 362/249

OTHER PUBLICATIONS

2000, Light–Cicles catalog; New Castle, Indiana; Christmas 2000; p. 17.

* cited by examiner

*Primary Examiner*—Thomas M. Sember
(74) *Attorney, Agent, or Firm*—Merchant & Gould P.C.

(57) ABSTRACT

The present invention relates to a mimic shaped Shell Body Light Sculpture. The main constructional feature is to mount decorative lights on and/or in the shell body of the mimic figure in the purpose of enhancing fidelity of the mimic figure decorative effects, so as to prolong the service life of the product and to make the product more convenient for use. The advantages of the present invention include: the mimic figure presenting integral sparkling starlight effects while it's lighted at night, and still presenting most vivid and life-like images while is not lighted at the daytime; resolving the problems of bulb breaking, falling off, power cords messing up, short circuits and so on, at the same time increasing the reuse rate, the transportation and installation, convenience, while the cost being reduced.

10 Claims, 6 Drawing Sheets

SHELL BODY LIGHT SCULPTURE

FIELD OF THE INVENTION

The present invention relates to a shell body light sculpture, in particular, a shell body light sculpture provided with decorative lights on and/or in it's shell.

BACKGROUND OF THE INVENTION

There are two kinds of light sculptures available in the present market. The first one is called Light Wire Sculpture or called Decorative Silhouette. It's made with metal or plastic wire or strip, wound and welded together to make a dummy animal or human being figure, on which a number of decorative lights are attached with ties or clips; the second one is called Blow-Mold Light Sculpture. It's to employ the blow-molding technique to make an integral dummy shell body in which 1 to 5 halogen bulbs, or illuminating lamps, or C7, C9 type lamps are fixed to illuminate the plastic shell. It can be noted that there are a number of defects existing in the above-mentioned light sculptures.

With regard to the first kind of light sculpture in the prior art, on the one hand, as it's made with metal or plastic wire or strip, the integral body only presents a skeletal frame work, far from achieving the realistic effects of appearance true to life; on the other hand, since the power cords and decorative lights are all exposed, the appearance is in a mess, the integral simulating effect is poor, the decorative effect is poor of course. Further more, the decorative lights on said light wire sculptures in prior art are all exposed, the bulbs are always broken and the lights would fall off during the transportation and installation. This would cause disconnection of power source or short circuit, resulting in totally or partially ceasing of illuminating.

With regard to the second kind of light sculpture in the prior art, first, it employs a blow-molded shell body, but it only employs with 1 to 5 common illuminating lamps or holgen bulbs all inside the shell body. This makes only a few portions, not all of the shell body illuminated, so the whole image cannot be seen at night. Second, as the shell body in the prior art is blow-molded as the whole piece, it's packing volume is comparatively quite large, causing higher cost and greater inconvenience in transportation and storage.

SUMMARY OF THE INVENTION

The main object of the present invention is to provide a shell body light sculpture, which can present static and realistic decorative effects by using shell body, fixed with many decorative lights. The lights or lighting rays shines through or out on the shell body to illuminated the whole shell body sculpture of various figures, such as animals, human being figures and articles etc.

The further object of the present invention is to provide a shell body light sculpture whose shell body is detachable and/or foldable. The packing volume is effectively reduced by means of using separable joints between various parts of the shell body, so that the transportation cost is greatly reduced and storage is much more convenient.

To achieve the above purposes, the present shell body light sculpture comprises a shell body of optional mimic figures and a plurality of series and/or paralleled decorative lights, wherein a plurality of decorative lights can be detachably mounted on the shell body.

A shell body light sculpture according to the present invention, wherein the shell body is provided with a number of hole portions for mounting the decorative lights; and a number of light buttons fitting the hole portions for fixing the decorative lights.

A shell body light sculpture according to the present invention, wherein the light button is provided with a wall portion to be fitted with the hole portion, used for gripping a lamp holder of the decorative light; and a shoulder portion projecting outward from the wall portion, used for lapping the shell body.

A shell body light sculpture according to the present invention, wherein the light button is provided with a slit extending across the shoulder portion and the wall portion.

A shell body light sculpture according to the present invention, wherein the slit is a conical slit widening gradually from the shoulder portion to the wall portion.

A shell body light sculpture according to the present invention, wherein the inner side of the wall portion is provided with hole portions mated with the prefabricated protrusions on the lamp holder of the decorative light.

A shell body light sculpture according to the present invention, wherein a base portion is provided on the inner side of the wall portion, used for fixing the lamp holder of the decorative light.

A shell body light sculpture according to the present invention, wherein protrusions are provided on the outer side of the wall portion with a space of constant pitch from the shoulder portion, used for fastening with the shell body.

A shell body light sculpture according to the present invention, wherein the light buttons are designed to be integrally shaped hole portions and are projecting from the inner side of the shell body.

A shell body light sculpture according to the present invention, wherein the shell body is provided with depression portions at the hole portion, for accessing the inlay stripes.

A shell body light sculpture according to the present invention, wherein the shell body is to be shaped through assemblage of detachable coupling parts.

A shell body light sculpture according to the present invention, wherein the coupling parts are disposed along the image body.

A shell body light sculpture according to the present invention, wherein the coupling parts of the shell body comprises a hole portion provided in one lateral edge of the shell body and a projecting pin provided correspondingly on the other lateral edge of the shell body, its capping head piercing through the hole portion.

A shell body light sculpture according to the present invention, wherein the coupling parts of the shell body comprise two hole portions provided correspondingly with each other in each lateral edge of the shell body; and one through pin having a cap-like end, piecing through the two hole portions.

A shell body light sculpture according to the present invention, wherein the coupling parts of the shell body comprise two hole portions provided in parallel with each other in each lateral edge of the shell body and one jam sheet having two spaced apart projecting pins, their capping heads piercing respectively through the two hole portions.

A shell body light sculpture according to the present invention, wherein the coupling parts of the shell body are of a mortise and tenon joint structure or a zipper socket joint structure.

A shell body light sculpture according to the present invention, wherein the coupling parts of the shell body comprise a groove provided on lateral edge of the shell body and a ledged portion provided correspondingly on the other lateral edge of the shell body mated with the groove.

A shell body light sculpture according to the present invention, wherein the coupling parts of the shell body comprise an inward curled knot curled inwardly from one lateral edge of the shell body and an outward curled knot curled outwardly from the other lateral edge of the shell body to be mated with the inward curled knot.

A shell body light sculpture according to the present invention, wherein the coupling parts of the shell body are of a hinge joint structure and/or a screw joint structure or a plastic hasp joint structure.

A shell body light sculpture according to the present invention, wherein the coupling parts of the shell body comprise at least two hole portions staggered with each other on each of the lateral edges of the shell body, and a through pin piercing through the at least two hole portions from outside of the shell body.

A shell body light sculpture according to the present invention, wherein surface of the shell body is provided with an ornamental layer.

According to one aspect of the present invention, as it adopts the process of fixing the decorative lighting strings from the inside of the shell body or intermediately of it, the decorative lights and its power cords are situated within said shell body or intermediately of it, so the problem of the lights falling off during transportation and use is properly resolved, and also the service life and reuse rate is increased greatly. According to the other one aspect of the present invention, as it employs a detachable and foldable shell body, the packing volume of the product is considerably reduced, so the transportation cost is reduced and storage space is greatly saved.

According to another aspect of the present invention, as said shell body is made up of several molded pieces (Not only whole big shell body), the shell body can be molded with great details, so said Shell Body Light Sculpture of the present invention can most vividly present the image it represents no matter whether it is illuminated at night or not at the day time.

BRIEF DESCRIPTION OF THE DRAWINGS

Now the present invention will be obvious by description combined with the following drawings and the preferred embodiments.

DESCRIPTION OF THE PREFERRED EMBODIMENTS

The following is further detailed descriptions for the present invention.

Figure 1:
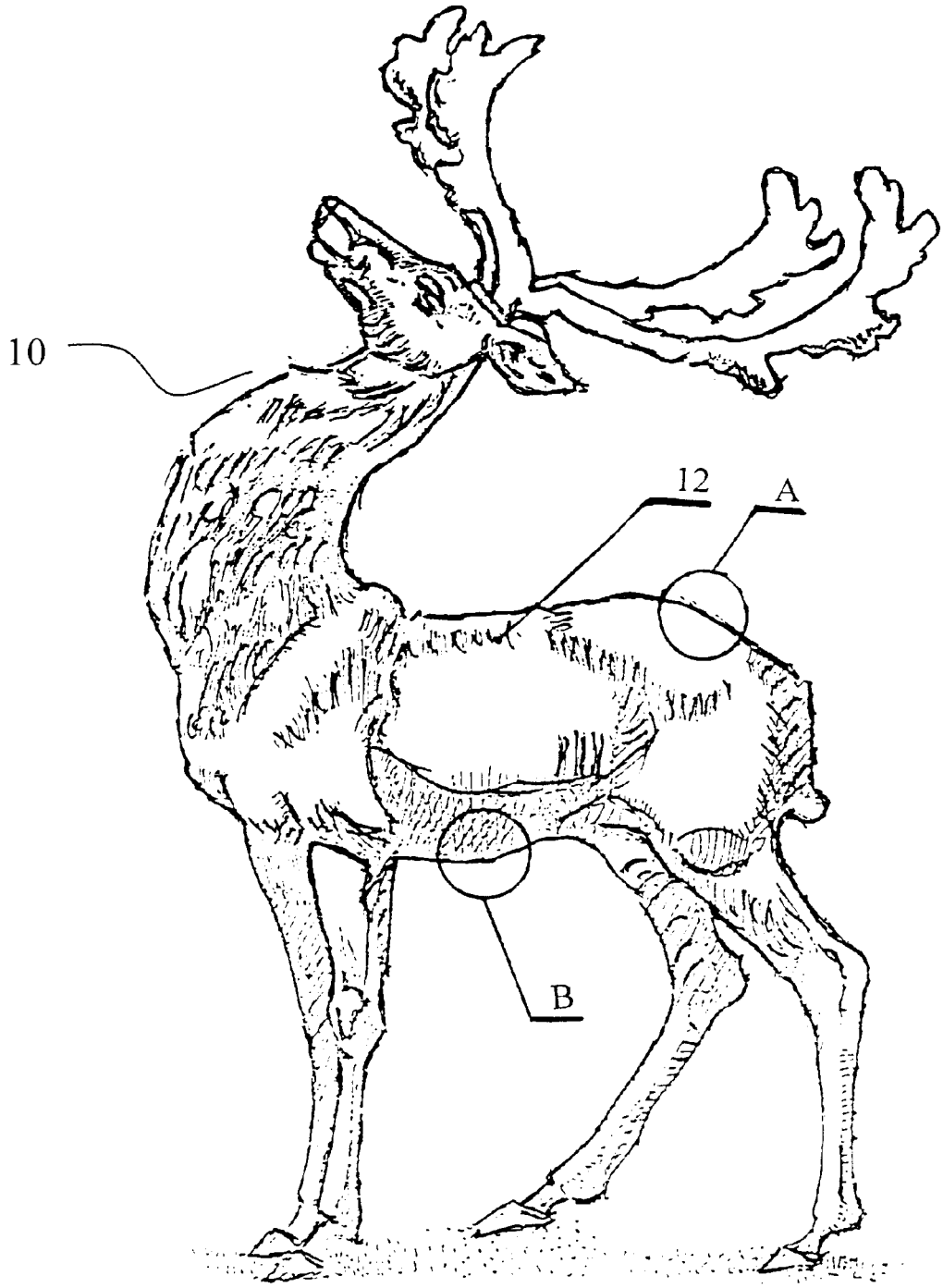
FIG. 1 is the integrally static schematic view of one of a shell body light sculptures of the present invention, as an image of deer assembled with a number of decorative lights on the shell body.
Figure 2:
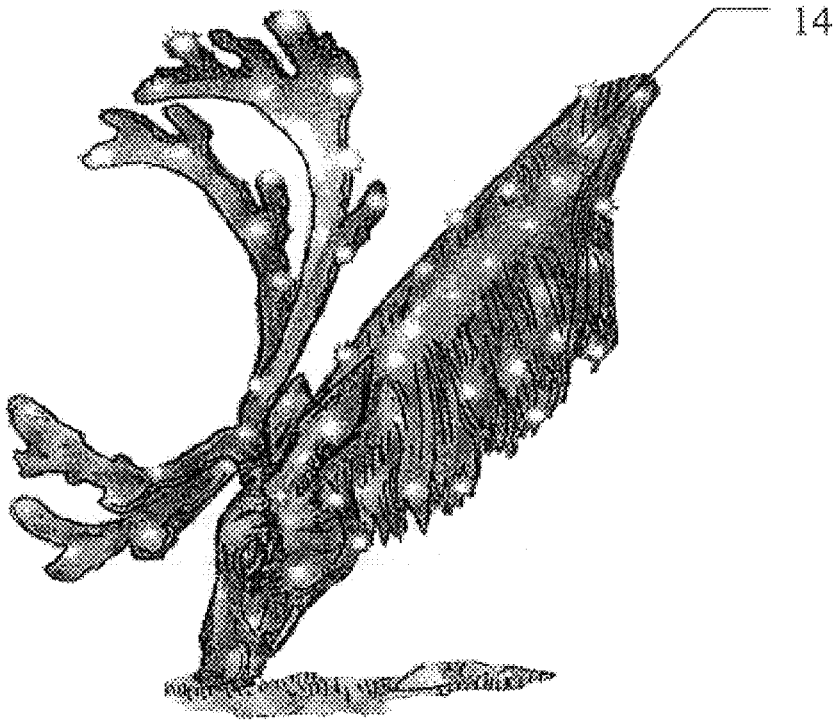
FIG. 2 is the partial schematic view of the embodiment shown in FIG. 1, showing the dynamic decorative lighting effects of the present invention while it's illuminated.

First, let's take one of the deer images as an example to describe the constructions of various parts of the shell body light sculpture 10 of the present invention. As shown in FIG. 1, for mounting said decorative lights, the convenient and lower cost transportation and storage, firstly, the integral figure is divided along its longitudinal axis into two separate divisions in which the shell body of the Shell Body Light Sculpture of the present invention is provided with detachable or foldable structure. Accordingly, it's necessary to provide coupling parts in the shell body, for example, at the location A or B. At the same time, a number of decorative lights 14 is detachably fixed on and/or in the shell body 12. While the lights lit up they produce dynamic light effects at the shell boy of the present invention, such as shown in the schematic view of the deer head in FIG. 2.

Figure 3:
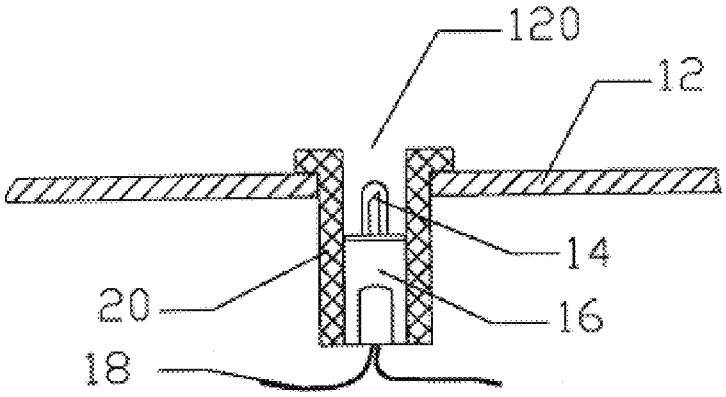
FIG. 3 is the schematic view of the first embodiment of the shell body of the present invention assembled with the decorative lights, showing how the light button hold the decorative lights.
Figure 4A:
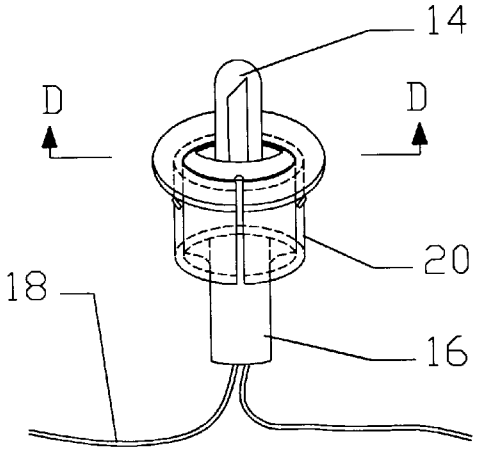
FIG. 4A is the schematic view showing the assemblage of decorative light with said light button of the present invention.
Figure 4B:
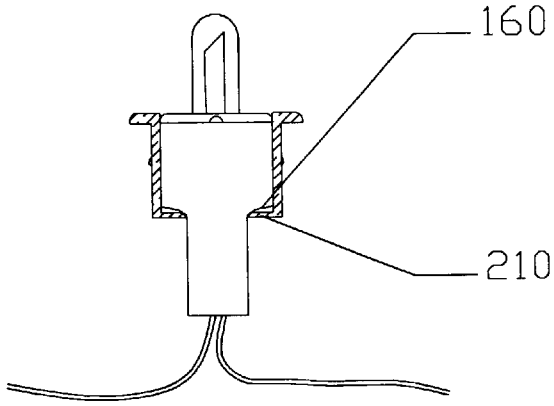
FIG. 4B is the sectional view adopted along line D—D in FIG. 4A.
Figure 5:
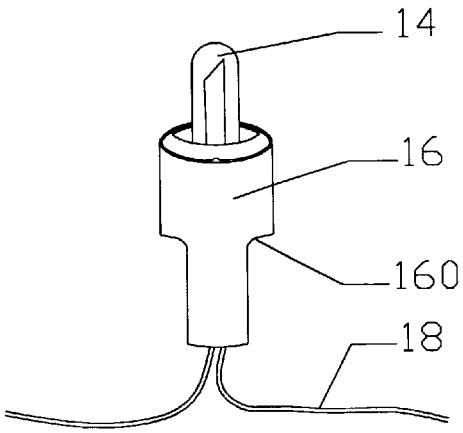
FIG. 5 is the perspective view of the decorative light bulb inserted in the lamp holder with depression portion for fixing with the said hole in said shell body of the present invention.
Figure 6A:
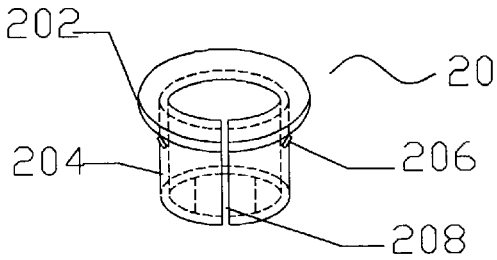
FIG. 6A is the perspective view of the light button of the present invention provided in the shell body, showing the Light Button fixed in the shell body by means of said shoulder portion and said protrusions on the wall portion of said light button.
Figure 6B:
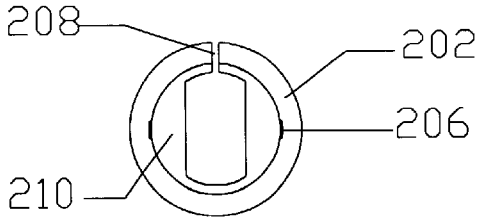
FIG. 6B is the bottom view of the light button of the present invention shown in FIG. 6A, showing the base portion provided at the bottom for holding the lamp holder of said decorative light.

The construction of the mounting of the decorative light 14 on and/or in the shell body 12 is shown in the first embodiment of the present invention shown in FIG. 3. In said first embodiment, a number of hole portions 120 are firstly provided in the shell body 12, and the decorative lights 14 are mounted on and/or in the shell body 12 by means of Light Buttons. Light Button 20 fitted in the hole portion 120. FIG. 4A is a schematic view showing the assemblage of the decorative light 14 of the present invention with the Light Button 20. More detailed perspective view of the decorative light 14 is shown in FIG. 5. The lamp holder 16 is used in the present invention to fix the decorative light 14, performing the function of protecting the decorative light 14, and the power cords 18 are used to connect other decorative lights (not shown). FIGS. 6A–6B show the detailed construction of the Light Button 20 of the present invention, it comprises integrally: a wall portion 204 mated with the hole portion 120, used for gripping the lamp holder 16; a shoulder portion 202 projecting outward from the wall portion 204, for lapping the shell body 12; a slit 208 extending across the shoulder portion 202 and the wall portion 204 used for inserting in said power cords 18 from this slit 208 to facilitate the mounting of said decorative light 14. Further more, to fasten the decorative light 14 tighter, the Light Button 20 also comprises a base portion 210 provided on the inner side of the wall portion 204 for fixing the shoulder portion of 160 of the lamp holder 16, as shown in FIG. 4B. As the Light Button 20 tightly grips the lamp holder 16, the slit 208 is preferably to be made in the form of a conical slit, widening gradually from the shoulder portion 202 to the wall portion 204. Besides, on the outer side of the wall portion 204, protrusions 206 are provided with space of a constant pitch from the shoulder portion 202, used for fastening with the shell body 12. Obviously, the decorative light 14 can be fixed tight enough, according to the practical requirement, it could be either higher than the outer surface of the shell body 12 or lower than the outer surface of the shell body 12 by adjusting the height of the Light Button 20.

Figure 7:
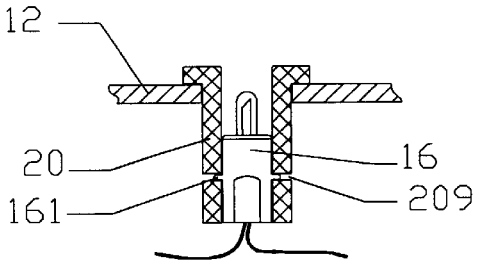
FIG. 7 is the schematic view of the second embodiment of the shell body of the present invention, assembled with the decorative lights, showing said light button anchoring said decorative light and said hole portion to be mated with the protrusions on the lamp holder of said decorative light.
Figure 8:
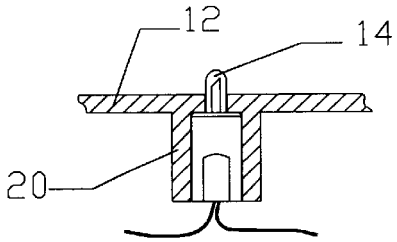
FIG. 8 is the schematic view of the third embodiment of the shell body of the present invention for disposing the decorative light.

The construction of the decorative light 14 mounted on and/or in the shell body 12 can be modified, if, as shown in FIG. 7, a plurality of hole portions 209 are provided in the wall portion of the Light Button 20 to be mated with the protrusions 161 prefabricated on the lamp holder 16, so the decorative lights are better fixed. The construction of the decorative light 14 assembled on and/or in the shell body 12 can be further simplified, if, as shown in FIG. 8, the Light Button 20 for accommodating the decorative light 14 is designed to be integral with the shell body 12 and projecting inwardly from the shell body 12.

Figure 9:
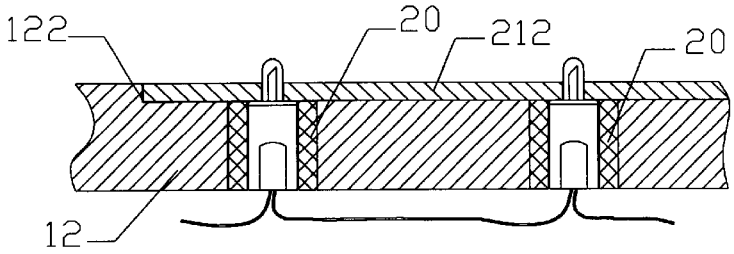
FIG. 9 is the schematic view of the fourth embodiment of the shell body of the present invention assembled with said decorative lights, showing the decorative lights fixed on said shell body by means of inlay stripes.

As shown in FIG. 9, it's also possible to provide a depression portion 122 in the shell body 12 near the hole portion and inlay stripes 212 to be also provided mated with the depression portions 122 to fix the decorative lights 14 of the present invention by embedding the inlay stripes 212 into the depression portions 122.

Figure 10:
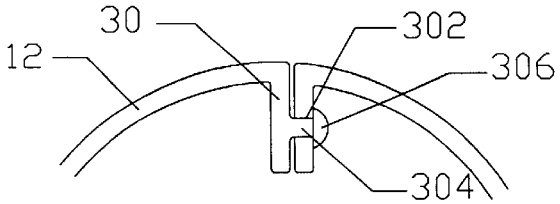
FIG. 10 is the schematic view of the first embodiment of the connecting of the coupling parts of the shell body as a deer image shown in FIG. 1, wherein the projecting pin provided on one segment of said shell body mated with the hole portions of the other segment.

It is more preferable that a foldable shell body structure is provided and used in the present invention. FIG. 10 is a schematic view of the first embodiment of the coupling parts 30 of the shell body of the present invention. The coupling parts 30 are substantially perpendicular with the shell body and comprise: a hole portion 302 provided on one lateral edge of the shell body 12; and a projecting pin 304 provided correspondingly on the other lateral edge of the shell body. Its capping head 306 pierces through the hole portion 302. Thus, the projecting pin 304 can fasten the two shell body segments 12 together.

Figure 11:
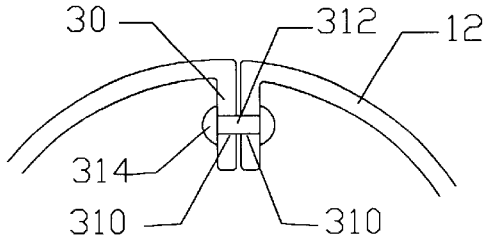
FIG. 11 is the schematic view of the second embodiment of the connecting of the coupling parts of the shell body as the deer image shown in FIG. 1, wherein through pin pierces through the hole portions provided in both shell body segments.

FIG. 11 is a schematic view of the second embodiment of connecting the coupling parts 30 of the shell body of the present invention, wherein the coupling parts 30 comprises: two hole portions 310 provided correspondingly with each other on each lateral edge of the shell body 12; and on through pin 312 having a cap-like end 314 piercing through the two hole portions 310 to fix the whole shell body 12.

Figure 12:
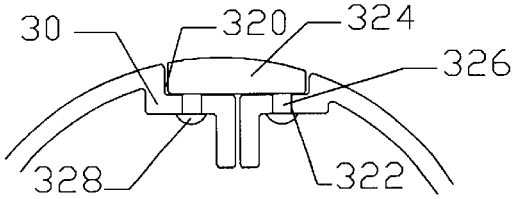
FIG. 12 is the schematic view of the third embodiment of the connecting of the coupling parts of the shell body as the deer image show in FIG. 1, wherein a jam sheet having two spaced apart projecting pins, the pins pierce respectively through the two hole portions in the shell body.

FIG. 12 is a schematic view of the third embodiment of connecting the coupling parts 30 of the shell body of the present invention, wherein the coupling parts 30 is first provided with an depression portion 320 and comprise: two hole portions 322, provided parallel with each other on each lateral edge of the shell body 12; and one jam sheet 324 having two spaced apart projecting pins 326, their capping heads 328 piercing respectively through the two hole portions 322. In this way, the jam sheet 324 is disposed in the depression portion 320, being substantially flush with the surface of the shell body 12.

Figure 13:
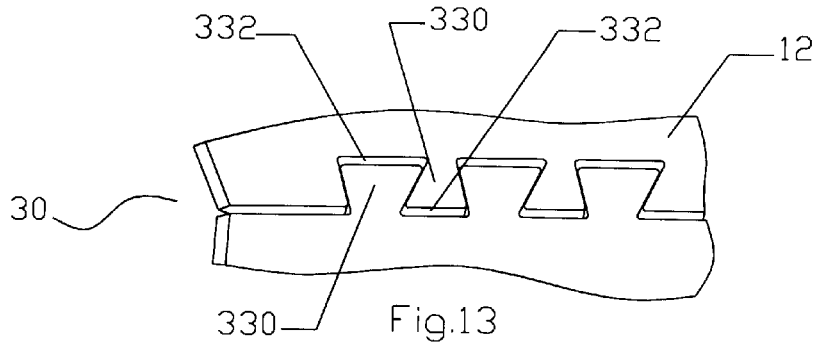
FIG. 13 is the schematic view of the fourth embodiment of the connecting of the coupling parts of the shell body as the deer image shown in FIG. 1, wherein said coupling parts have mortise and tenon joint structure.

FIG. 13 is a schematic view of the fourth embodiment of connecting the coupling the portions 30 of the shell body of the present invention, wherein each shell body segment 12 is respectively provided with: a tenon 330; and a mortise 332, so to form a mortise and tenon joint structure.

Figure 14:
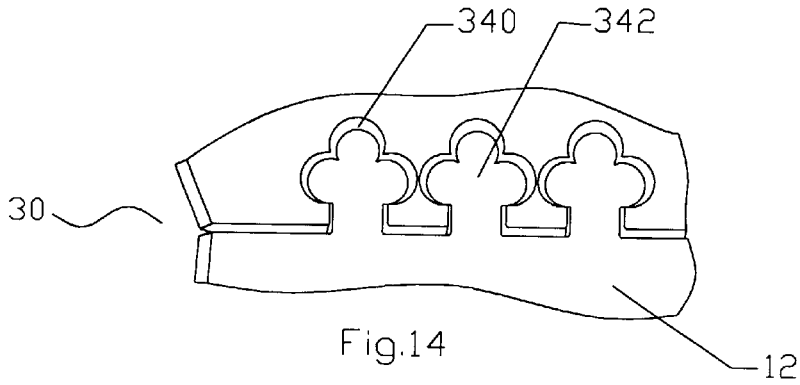
FIG. 14 is the schematic view of the fifth embodiment of the connecting of the coupling parts of the shell body as the deer image shown in FIG. 1, wherein the coupling parts are of zipper socket joint structure.

FIG. 14 is the schematic view of the fifth embodiment of connecting the coupling the portions 30 of the shell body of the present invention, wherein the coupling parts 30 comprises: a number of female tooth grains 340 provided on one side of the shell body segments 12; and a number of male tooth grains 342 provided on the other shell body segment 12, so as to for a zipper socket joint structure.

Figure 15A:
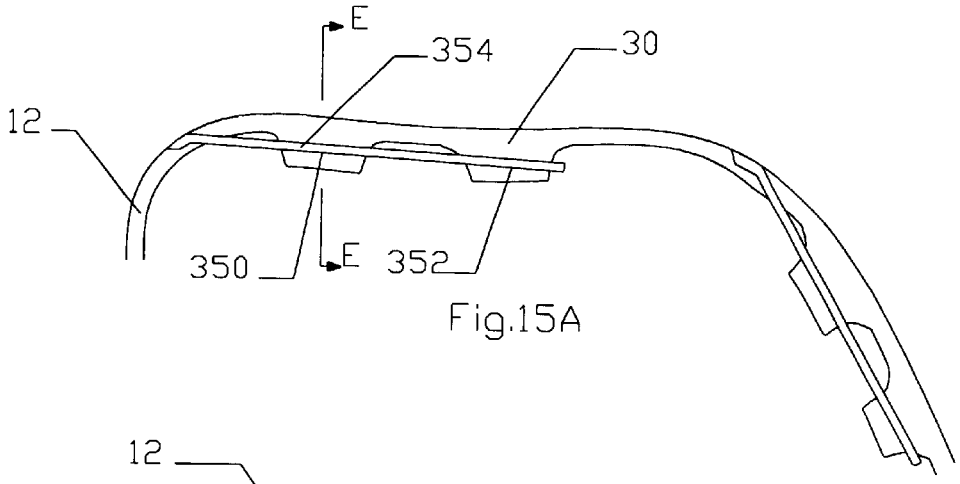
FIG. 15A is the schematic view of the sixth embodiment of the connecting of the coupling parts of the shell body as the deer image shown in FIG. 1, wherein the through pin pierces through the staggered hole portions in the two shell body segments.
Figure 15B:
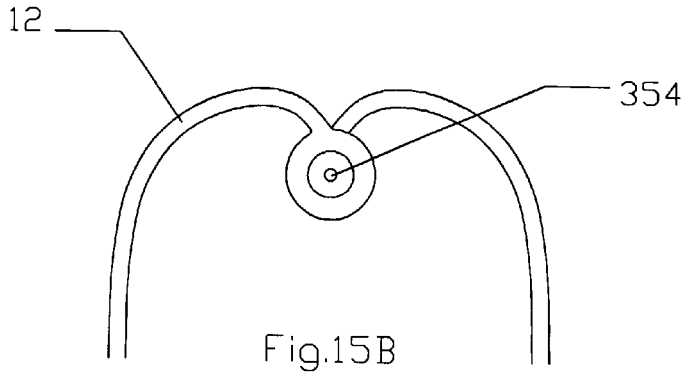
FIG. 15B is the sectional view of the embodiment shown in FIG. 15A adopted along line E—E.

FIG. 15A is a schematic view of the sixth embodiment of connecting the coupling the portions 30 of the shell body of the present invention, wherein the coupling parts 30 comprises: two hole portions 350 and 352, provided aligned and staggered with each other on each lateral edge of the shell body 12; and a through pin 354, piercing through the two hole portions 350 and 352 from outside of the shell body 12, so as to form a folding cylinder joint structure, as shown in the sectional view of FIG. 15B.

Figure 16:
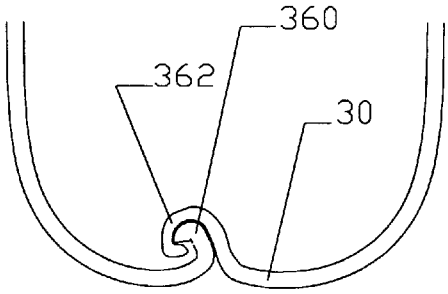
FIG. 16 is the schematic view of the seventh embodiment of the connecting of the coupling parts of the shell body as the deer image shown in FIG. 1, wherein the outward curled knot provided on one shell body segment is mated with the inward curled knot provided in the other segment.

FIG. 16 is a schematic view of the seventh embodiment of connecting the coupling parts 30 of the shell body of the present invention, wherein the coupling parts 30 comprise: an inward curled knot 360, curled inwardly from one lateral edge of the shell body 12; and an outward curled knot 362, curled outwardly from the other lateral edge of the shell body 12 mated with the inward curled knot 360. Of course, the shell body has fairly good resilience.

Figure 17:
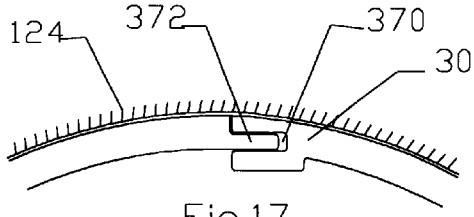
FIG. 17 is the schematic view of the eighth embodiment of the connecting of the coupling parts of the shell body as the deer image shown in FIG. 1, wherein the ledge portion provided on one shell body segment is mated with the groove provided in the other segment and the surface of the shell body is covered with an ornamental layer.

FIG. 17 is a schematic view of the eighth embodiment of connecting the coupling parts 30 of the shell body of the present invention, wherein the coupling parts 30 comprises: a groove 370, provided on one lateral edge of said shell body 12; and a ledge portion 372 provided correspondingly on the other lateral edge of said shell body mated with said groove.

Figure 18:
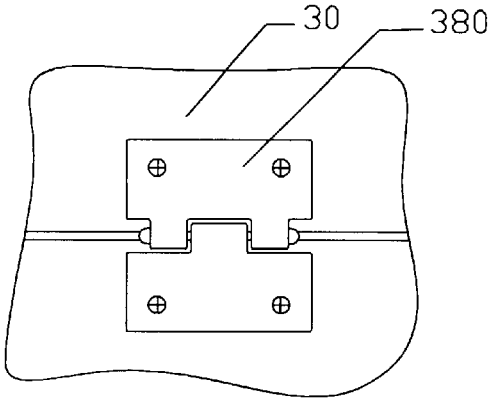
FIG. 18 is the schematic view of the ninth embodiment of the connecting of the coupling parts of the shell body as the deer imaged shown in FIG. 1, wherein the coupling parts are of a hinge structure.

FIG. 18 is a schematic view of the ninth embodiment of connecting the coupling parts 30 of the shell body of the present invention, wherein the coupling parts 30 employs a hinge joint 380, that is, the two limb flaps of the hinge joint are separately provided on each of the two shell body segments, so that the shell body of present invention in foldable.

Figure 19:
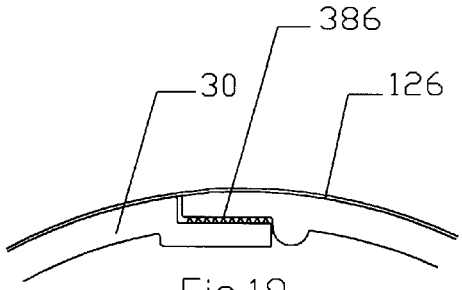
FIG. 19 is the schematic view of the tenth embodiment of the connecting of the coupling parts of the shell body as the deer image shown in FIG. 1, wherein the coupling parts comprises the plastic hasp.

FIG. 19 is a schematic view of the tenth embodiment the connecting the coupling parts 30 of the shell body of the present invention, wherein the coupling parts 30 provide a plastic hasp 386 on the overlapping portions of the two shell body segments 12 to for a simply constructed joint.

Figure 20:
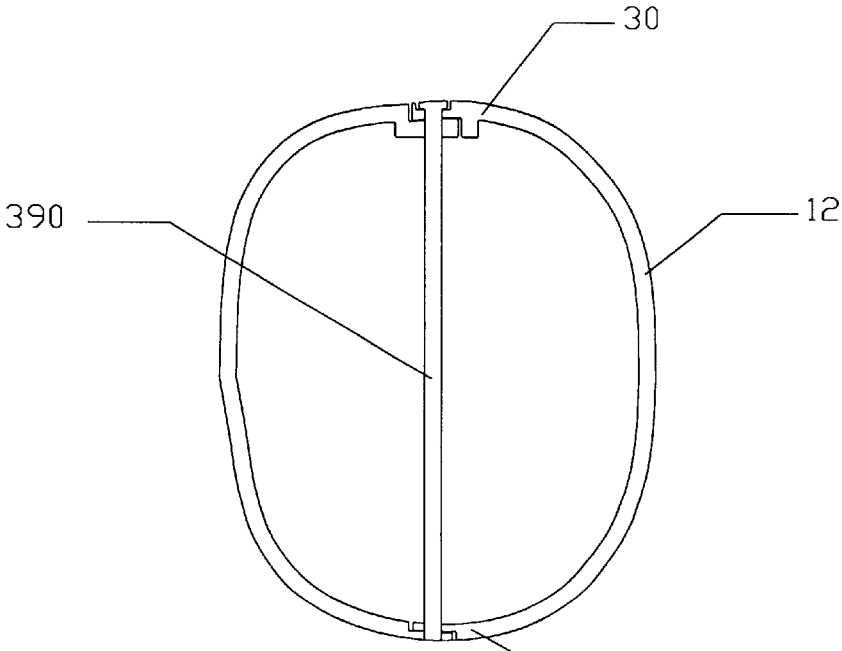
FIG. 20 is the schematic view of the eleventh embodiment of the connecting of the coupling parts of the shell body as the deer imaged shown in FIG. 1, wherein the coupling parts are connected with pin piercing through the shell body.

FIG. 20 is a schematic view of the eleventh embodiment of the connecting the coupling parts 30 of the shell body of the present invention, wherein the coupling parts 30 comprise a through pin 390, piercing directly through the upper and lower sides of the shell body 12.

Apparently, in order to enhance the ornamental effect, the shell body of the present invention can be covered with various ornamental layers, such the scored layer 124 shown in FIG. 17 and the coating layer or paint layer 126 shown in FIG. 19.

While the present invention has been described with reference to the above-mentioned preferred embodiments, it should be understood that various changes and modifications could be made within the protection scope of the appended claims.

What is claimed is:

1. A shell body light sculpture comprising:

a shell body of optional mimic figures, said shell body comprising a number of hole portions;

a plurality of series and/or paralleled decorative lights detachably mounted on said shell body; and a number of light buttons fitting said hole portions for fixing said decorative lights, said light buttons comprising a wall portion to be fitted within said hole portion for gripping a lamp holder of said decorative light, and a shoulder portion projecting outward from said wall portion that is capable of lapping an exterior surface of said shell body, the light button having a slit extending across said shoulder portion and side wall portion from a first end of said wall portion where said shoulder portion projects outward to a second end of said wall portion.

2. A shell body light sculpture according to claim 1, wherein said slit is a conical slit widening gradually from said shoulder portion to said wall portion.

3. A shell body light sculpture according to claim 1, wherein an inner side of said wall portion is provided with hole portions capable of mating with prefabricated protrusions on said lamp holder of said decorative light.

4. A shell body light sculpture according to claim 1, wherein a base portion is provided on the inner side of said wall portion, used for fixing said lamp holder of said decorative light.

5. A shell body light sculpture according to claim 1, wherein protrusions are provided on the outer side of said wall portion with a space of constant pitch from said shoulder portion, used for fastening with said shell body.

6. A shell body light sculpture according to claim 1, wherein said light buttons are designed to be integrally shaped hole portions and are projecting from the inner side of said shell body.

7. A shell body light sculpture according to claim 1, wherein said shell body is to be shaped through assemblage of detachable coupling parts.

8. A shell body light sculpture according to claim 7, wherein said coupling parts are disposed along the image body.

9. A shell body light sculpture according to claim 1, wherein surface of said shell body is provided with an ornamental layer.

10. A shell body light sculpture comprising:

a shell body of optional mimic figures, the shell body comprising a number of hole portions;

a plurality of series and/or paralleled decorative lights detachably mounted in the hole portions of the shell body; and a number of light buttons fitting within the hole portions for fixing the decorative lights to the shell body, the light buttons comprising a wall portion to be fitted with said hole portion for gripping a lamp holder of the decorative lights, a shoulder portion projecting outward from said wall portion for lapping said shell body, and a slit extending across said shoulder portion and side wall portion;

wherein said slit widens from said shoulder portion at a top end of said wall portion to a bottom end of said wall portion.

* * * * *